United States Patent [19]

Steel

[11] 4,404,954

[45] Sep. 20, 1983

[54] FIREPLACE FURNACE

[76] Inventor: James S. Steel, 841 Bowie Rd., Rockville, Md. 20852

[21] Appl. No.: 228,717

[22] Filed: Jan. 27, 1981

[51] Int. Cl.[3] ..... F24J 3/02

[52] U.S. Cl. ..... 126/121; 125/77; 126/67; 126/123

[58] Field of Search ..... 126/121, 120, 123, 61, 126/66, 77, 126, 67, 193

[56] References Cited

U.S. PATENT DOCUMENTS

| | | | |
|---|---|---|---|
| 2,360,611 | 10/1944 | Leonard | 126/121 |
| 2,642,859 | 6/1953 | Brown | 126/121 |
| 4,154,212 | 5/1979 | Wilkinson | 126/193 X |
| 4,170,219 | 10/1979 | Hansen et al. | 126/121 |
| 4,177,791 | 12/1981 | Marchant | 126/193 X |
| 4,304,215 | 12/1981 | Jarman | 126/121 |

*Primary Examiner*—Larry Jones

*Attorney, Agent, or Firm*—Larson and Taylor

[57] ABSTRACT

A fireplace furnace for the hot air heating of a room is disclosed. The fireplace furnace in a particular embodiment has an enclosed primary combustion chamber and a primary air supply for the initial burning of the fuel. A separate enclosed secondary combustion chamber and a secondary air supply for burning the volatiles remaining in the flue gas generated by the primary combustion chamber is also provided. The secondary combustion chamber is located between the primary combustion chamber and an enclosed room air heating chamber. The flow of the air in the room air heating chamber is counter to the flow of the flue gas in the secondary combustion chamber. With this construction, the heat transferred to the room air is from the flue gas of the secondary combustion chamber and none of the heat transferred to the room air is transferred directly from the primary combustion chamber.

26 Claims, 5 Drawing Figures

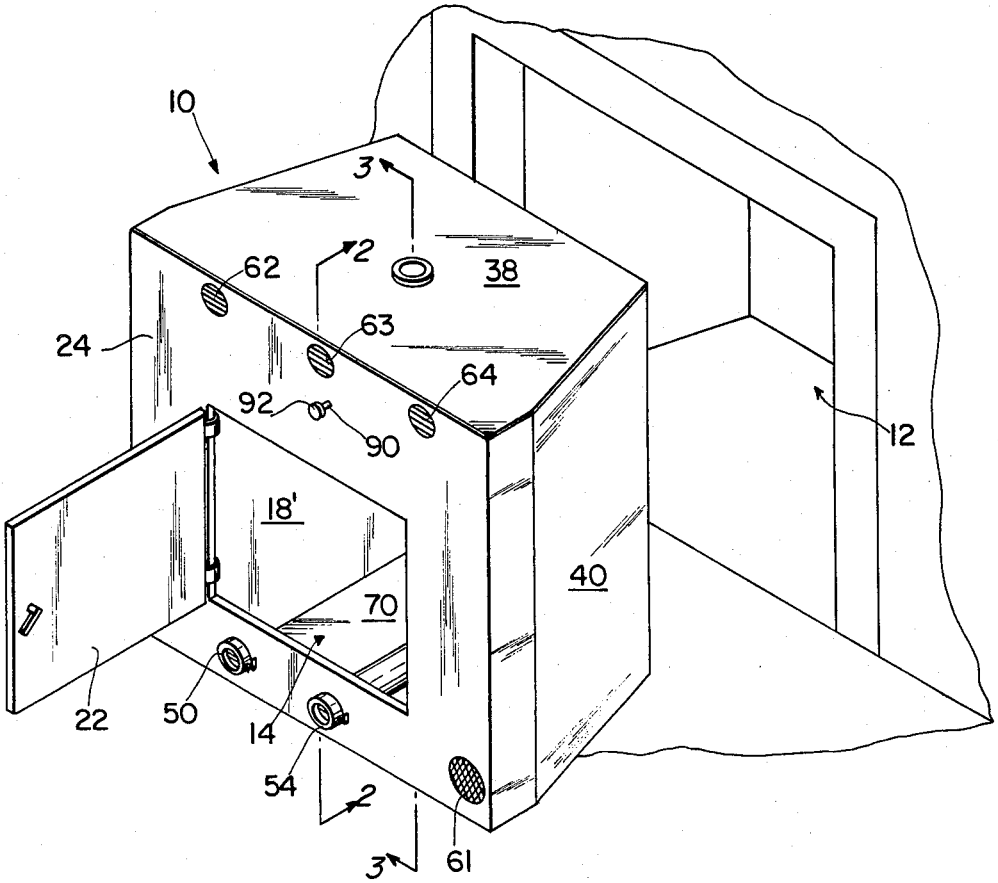
FIG. 1
FIG. 2
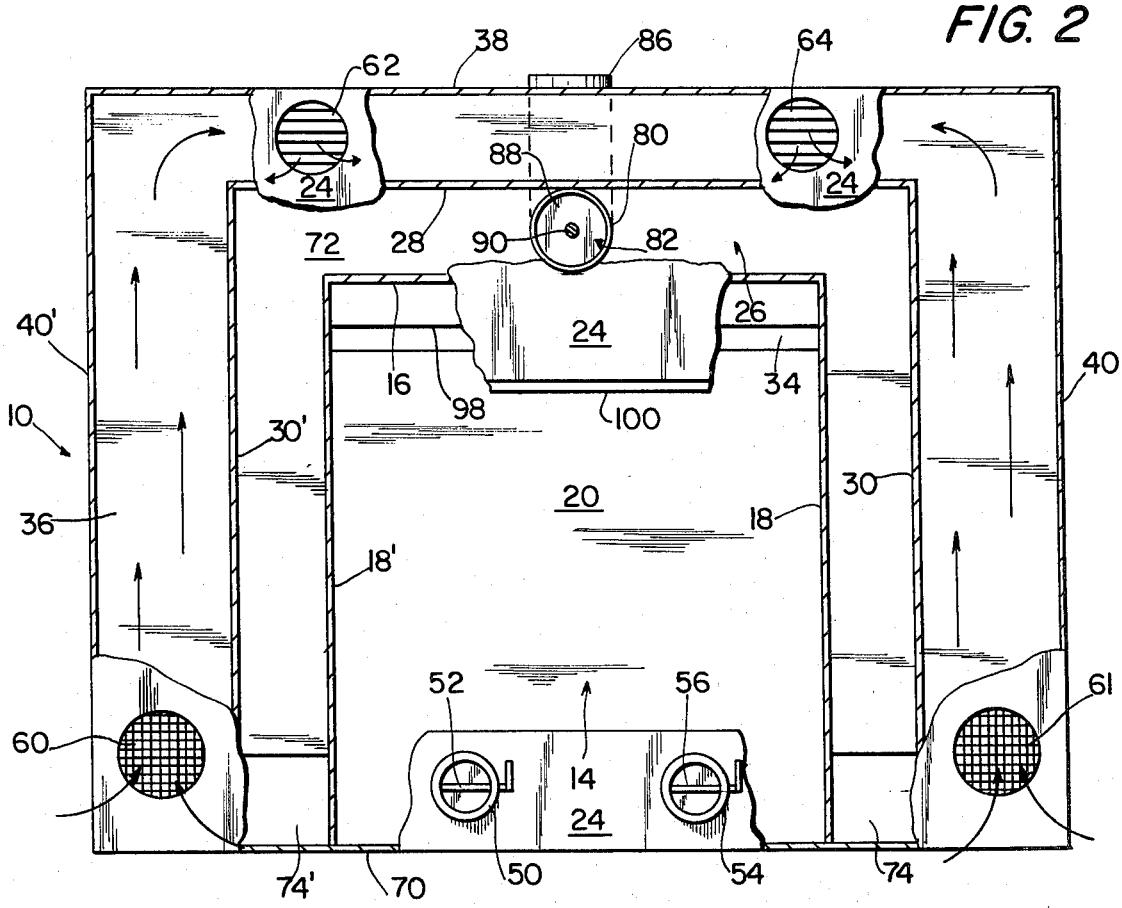

FIREPLACE FURNACE

FIELD OF THE INVENTION

This invention relates generally to the hot air heating of a room and more particularly relates to a fireplace furnace for heating the room air.

BACKGROUND OF THE INVENTION

The heating of rooms using a fireplace or fireplace furnace is well known in the prior art. Ordinarily, these prior art systems burn a fuel such as wood and are frequently very inefficient.

In an effort to improve the efficiency of fireplace furnaces and the like, prior art systems have provided for both a primary burning of the fuel and a secondary combustion of the flue gases. Prior U.S. Pat. Nos. which disclose secondary combustion include the following: 4,180,052 to Henderson, 4,078,541 to Roycraft; 4,111,181 to Canney; 1,341,580 to Pelton; and 4,192,285 to Nietupski. It has also been suggested in the prior art that an increase in the efficiency of fireplace furnaces can be achieved by directing the room air to be heated in a counter flow direction with respect to the flue gases produced by combustion of the fuel. Such a counter flow of the room air is disclosed in U.S. Pat. Nos. 4,089,320 to Brown et al and 3,171,399 to Kirgan.

While many of the prior art systems have significantly increased the efficiency of a fireplace furnace relative to an open fireplace, some of the heat produced by the burning of the fuel is still wasted. With the rising cost of fuel, the utilization of as much of the heat produced by the burning of the fuel is important.

SUMMARY OF THE INVENTION

The present invention provides a novel system for the efficient hot air heating of a room using a fireplace furnace. With the present invention, the fuel is initially burned in an enclosed primary combustion chamber. The initial burning of the fuel produces a flue gas in which volatiles are contained. The flue gas is then conducted to an enclosed secondary combustion chamber where the volatiles remaining in the flue gas are combusted. The secondary combustion chamber is disposed between the primary combustion chamber and a room air heating chamber. With this construction, all of the heat transferred to the room air in the room air heating chamber comes from the flue gas in the secondary combustion chamber after the secondary combustion takes place. Thus, the primary combustion chamber is insulated from direct heat exchange with the room air thereby permitting increased temperature in the primary and secondary combustion chambers.

It is a feature of the present invention that the burning of the volatiles in the secondary combustion chamber occurs at the highest possible temperature because none of the heat energy produced by the burning of the fuel in the primary combustion chamber is directly transferred to the room air to be heated. The high flue gas temperature resulting from the burning of the fuel in the primary combustion chamber promotes the burning of the volatiles in the secondary combustion chamber. In particular, volatiles such as carbon monoxide and creosote are completely burned so that fouling of the chimney is prevented. It is a further feature of the present invention that heat is not transferred from the flue gas in the secondary combustion chamber to the room air until after the burning of the volatiles in the secondary combustion chamber.

In a preferred embodiment of the present invention, a primary air supply means for the primary combustion chamber and a secondary air supply means for the secondary combustion chamber are provided. Preferably, the secondary air supply means includes an air duct passing through the primary combustion chamber so that the combustion air delivered to the secondary combustion chamber is preheated. Adjustable air dampers are also provided for the primary and secondary air supply means so that the correct quantity of combustion air is provided.

In the preferred embodiment, a baffle means is also located in the secondary combustion chamber. The purpose of the baffle means is to direct the hot flue gas of the secondary combustion chamber around the outside of the primary combustion chamber. In this manner, the temperature inside of the primary combustion chamber is maintained high and heat is more efficiently transferred from the secondary combustion chamber to the surrounding room air heating chamber. For best efficiency, the flow of room air in the room air heating chamber is counter to the flow of the flue gas in the secondary combustion chamber.

Other features, objects and advantages of the present invention are stated in or apparent from the presently preferred embodiment of the invention found hereinbelow.

BRIEF DESCRIPTION OF THE DRAWINGS

FIG. 1 is a perspective view of the fireplace furnace of the present invention.

FIG. 2 is a front elevational view partly in cross-section and with some parts broken away of the fireplace furnace depicted in FIG. 1 taken along lines 2—2 therein.

DETAILED DESCRIPTION OF THE PREFERRED EMBODIMENTS

Figure 3:
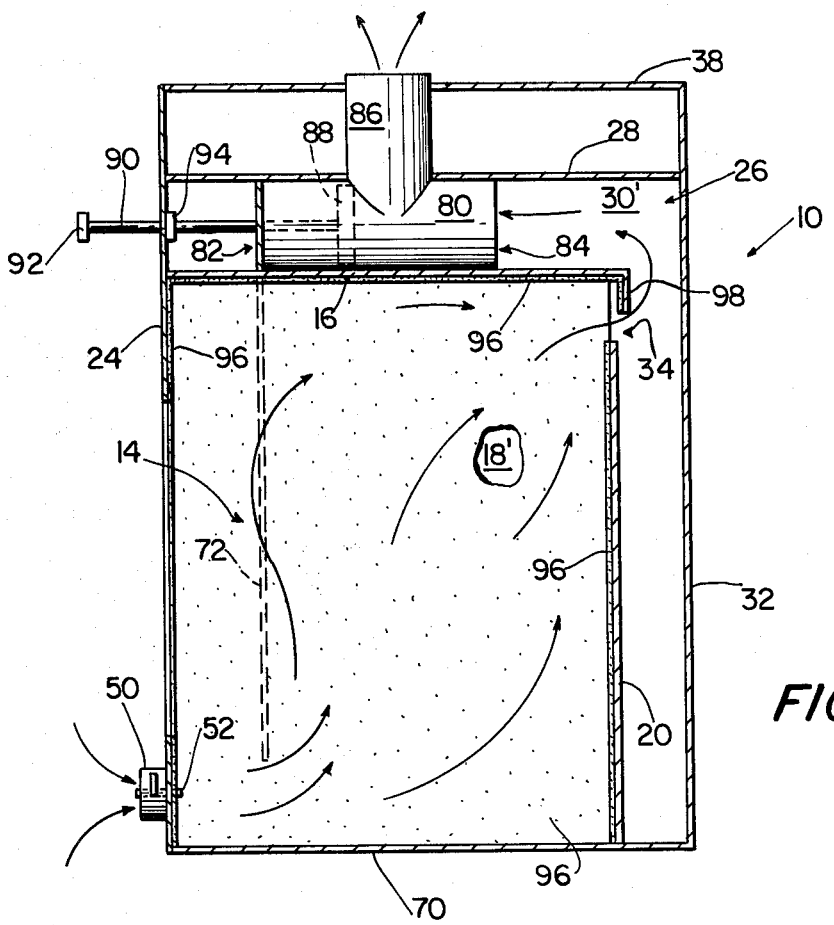
FIG. 3 is a cross-sectional side view of the present invention taken along the line 3—3 in FIG. 1 and slightly modified.

With reference now to the drawings in which like numerals represent like elements throughout the several views, a presently preferred embodiment of the present invention is depicted in FIG. 1 and comprises a fireplace furnace 10 which can be inserted in an existing fireplace 12. Of course, fireplace furnace 10 can be built, rather than inserted, in fireplace 12. Referring now to the additional figures, it is seen that fireplace furnace 10 has a primary combustion chamber 14. Primary combustion chamber 14 has a top wall 16, side walls 18 and 18', and a back wall 20. Access to primary combustion chamber 14 is provided through a door 22 in a front wall 24 of fireplace furnace 10.

Surrounding the top wall 16, side walls 18 and 18', and back wall 20 of primary combustion chamber 14 is a secondary combustion chamber 26. Secondary combustion chamber 26 is also enclosed and has a top wall 28, side walls 30 and 30', and a back wall 32. As best shown in FIG. 3, fluid communication between secondary combustion chamber 26 and primary combustion chamber 14 is provided by a gap 34 between top wall 16 and back wall 20 of primary combustion chamber 14.

Figure 4:
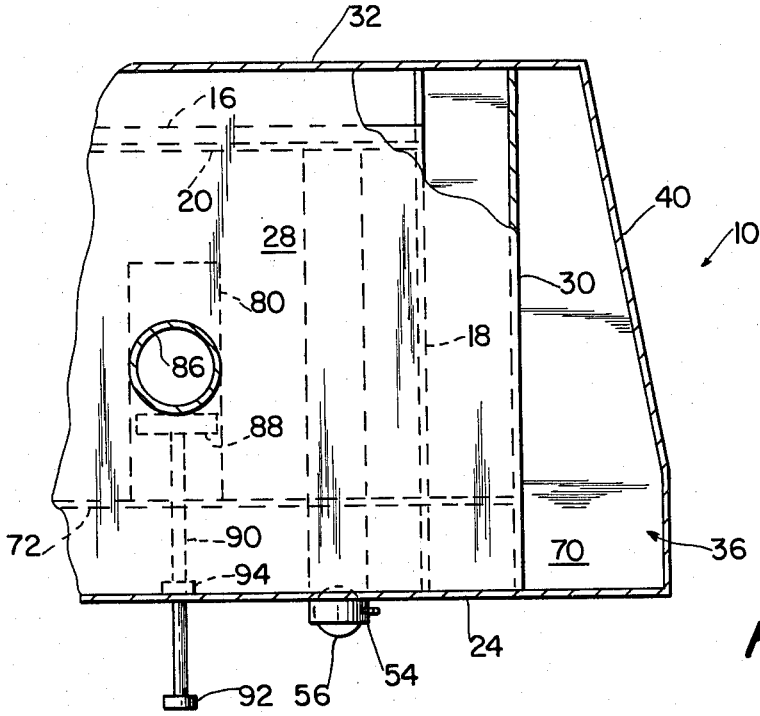
FIG. 4 is a partial top plan cross-sectional view of the fireplace furnace depicted in FIG. 1.

Surrounding top wall 28 and side walls 30 and 30' of secondary combustion chamber 26 is an enclosed room air heating chamber 36. Room air heating chamber 36 includes a top wall 38 and side walls 40 and 40'. As shown in FIGS. 1 and 4, the spacing between side walls 30 and 40 and side walls 30' and 40' is progressively smaller as the distance from back wall 32 decreases. In this manner, fireplace furnace 10 is sized to fit into fireplace 12 which has similarly angled side walls.

A primary air inlet duct 50 is provided in front wall 24 below door 22. As shown in FIG. 3, a pivoted air inlet damper 52 is located in primary air inlet duct 50. When pivoted air inlet damper 52 is open, air for combustion is free to pass through primary air inlet duct 50 to primary combustion chamber 14. Normally, a grate (not shown) which supports the fuel to be burned is located in primary combustion chamber 14. Running below the location of this grate is a secondary air inlet duct 54. Secondary air inlet duct 54 passes through front wall 24 and back wall 20 of primary combustion chamber 14. Secondary air inlet duct 54 is provided with a pivoted air inlet damper 56.

Providing fluid communication between room air heating chamber 36 and the room to be heated are room air inlets 60 and 61 located near the bottom and on either side of front wall 24. Also located in front wall 24 along the top are room air outlets 62, 63 and 64 which also provide fluid communication between room air heating chamber 36 and the room to be heated. The combined area of outlets 62, 63 and 64 is at least as large as the combined area of inlets 60 and 61, and preferably is somewhat larger, if natural circulation of room air is utilized.

In the preferred embodiment, fireplace furnace 10 is provided with a bottom wall 70 which encloses the bottoms of room air heating chamber 36, secondary combustion chamber 26, and primary combustion chamber 14. Located in secondary combustion chamber 26 is a baffle plate 72. As shown, baffle plate 72 extends between top wall 28 and top wall 16 and along side walls 18 and 30 and 18' and 30'. Gaps 74 and 74' are provided between the ends of baffle plate 72 and bottom wall 70.

Located in the middle of secondary combustion chamber 26 is a damper duct 80 having an opening 82 in baffle plate 72 and an opening 84 at the other end of damper duct 80. An exhaust duct 86 is provided in fluid communication with the middle portion of damper duct 80. As shown, exhaust duct 86 extends from damper duct 80 through top walls 28 and 38. Located inside of damper duct 80 is a slidable damper piston 88. Attached to damper piston 88 is a piston rod 90 which extends through front wall 24. Piston rod 90 has two stops 92 and 94 attached thereto. When stop 92 engages front wall 94, damper piston 88 is located on the back side of exhaust duct 86. Similarly, when stop 94 engages front wall 24, damper piston 88 is located on the front side of exhaust duct 86.

In operation, fireplace furnace 10 functions in the following manner when inserted into a fireplace 12. Before starting the fire in primary combustion chamber 14, piston rod 90 is pulled outward until stop 94 engages front wall 24. Next, pivoted air inlet damper 52 in primary air inlet duct 50 is pivoted to the open position and pivoted air inlet damper 56 in secondary air inlet duct 54 is shut. When the fuel in primary combustion chamber 14 is ignited, air for combustion is admitted through primary air inlet duct 50. As shown in FIG. 3, the flue gas produced in primary combustion chamber 14 passes through gap 34 into secondary combustion chamber 26. The flue gas then proceeds along top wall 28 and enters damper duct 80 directly. From damper duct 80, the flue gas flows through exhaust duct 86 and up the chimney of fireplace 12.

Figure 5:
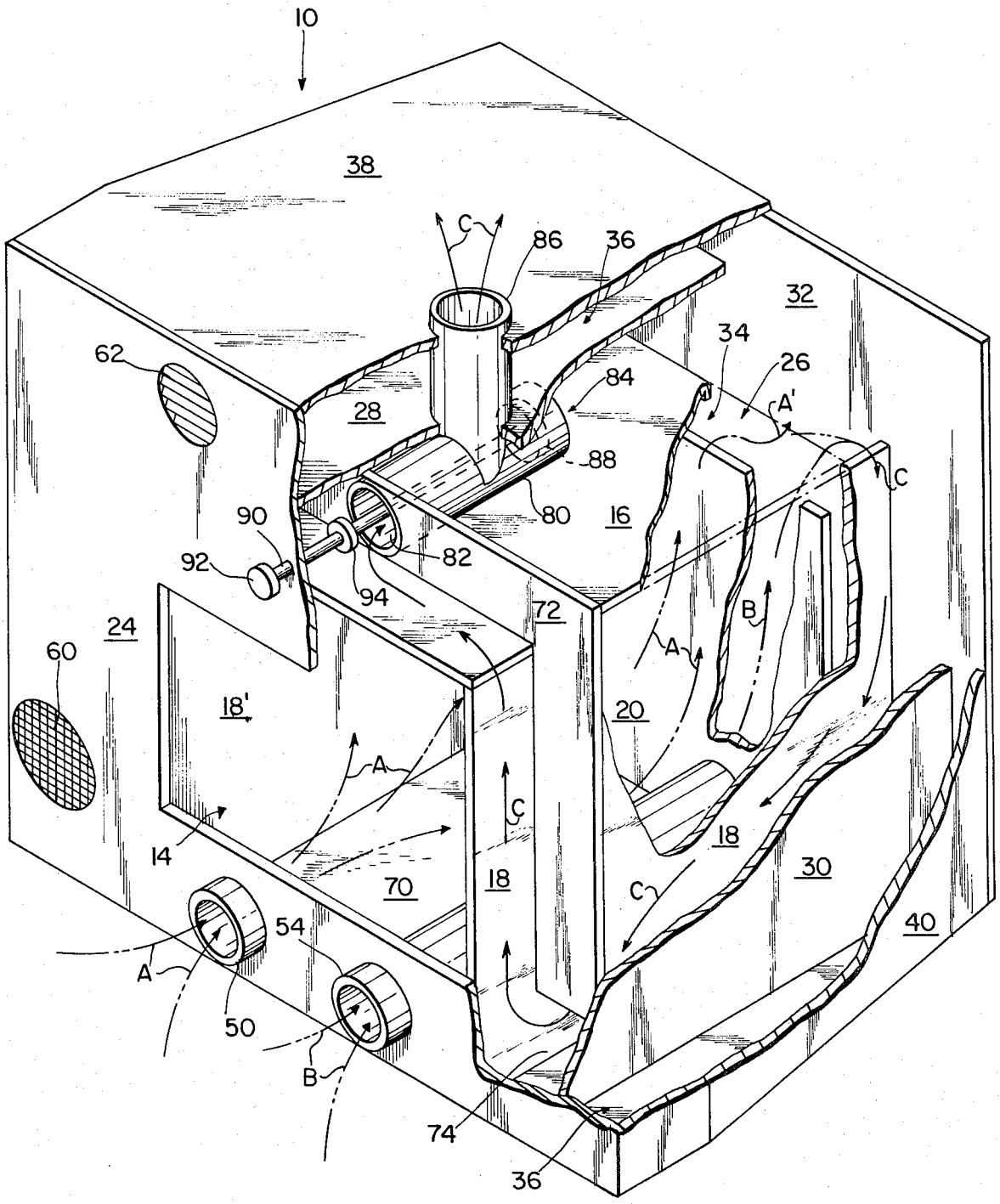
FIG. 5 is a partially cut-away perspective view showing the air flow patterns of the fireplace furnace depicted in FIG. 1.

Once the chimney in fireplace 12 has been heated sufficiently during startup to establish draft, pivoted air inlet damper 56 in secondary air inlet duct 54 is opened. At the same time, damper piston 88 in damper duct 80 is moved to the rear of damper duct 80 by pushing stop 92 until it engages front wall 24. This changes the flow of air to that depicted in FIG. 5. As shown, combustion air for primary combustion chamber 14 still enters through primary air inlet duct 50. This combustion air is labelled with the letter "A". After combustion with the fuel, the flue gas in primary combustion chamber 14 denoted "A'" contains a number of unburned volatiles. This flue gas "A'" containing the volatiles flow through gap 34. At the same time, combustion air for secondary combustion chamber 26 flows in secondary air inlet duct 54, through primary combustion chamber 14, and into the bottom of secondary combustion chamber 26 behind primary combustion chamber 14. The flow of the combustion air for secondary combustion chamber 26 is labelled with the letter "B". This combustion air is preheated as it flows through the portion of secondary air inlet duct 54 located in primary combustion chamber 14. The heated combustion air "B" for secondary combustion chamber 26 combines with the flue gas containing the volatiles "A'" adjacent gap 34. This causes the volatiles in flue gas "A'" to burn completely adjacent gap 34 forming a flue gas labelled "C". The flue gas "C" has a higher temperature than the flue gas "A". Flue gas "C" surrounds primary combustion chamber 14 as it flows around baffle plate 72 through gap 74 and into opening 82 in damper duct 80. From damper duct 80, flue gas "C" flows through exhaust duct 86 into the chimney of fireplace 12.

The flow of the room air being heated is depicted in FIG. 2. As shown, the cool room air enters air inlet 60 and 61, rises due to natural convection in room air heating chamber 36 as the air is heated, and exits through room air outlets 62, 63, and 64. It should be noted that all of the heat which is transferred to the room air is conducted through side walls 30 and 30' and top wall 28 of secondary combustion chamber 26 and occurs after burning of the volatiles adjacent gap 34 in secondary combustion chamber 26. None of the heat transferred to the room air is directly transferred from primary combustion chamber 14. With this construction, the temperature in primary combustion chamber 14 is maintained as high as possible.

By use of pivoted air inlet dampers 52 and 56 and a sealed door 22, the precise amount of combustion air necessary for both primary combustion chamber 14 and secondary combustion chamber 26 is provided. As the fuel is burned, pivoted air inlet dampers 52 and 56 are adjusted and when the fire goes out, pivoted air inlet dampers 52 and 56 are closed. In this manner, warm room air is not lost through fireplace furnace 10 and up through the chimney of fireplace 12.

In order to increase the temperature and primary combustion chamber 14, a layer of insulation 96 is provided on the interior walls of primary combustion chamber 14 as shown in FIG. 3. This helps prevent heat transfer from primary combustion chamber 14 to secondary combustion chamber 26. Instead of locating the layer of insulation 96 on the interior walls of primary combustion chamber 14, it would also be possible to locate the layer of insulation on the exterior side of the walls of primary combustion chamber 14. It is also possible to raise the temperature in primary combustion chamber 14 by providing a lip 98 depending from the back edge of top wall 16. Lip 98 then acts to trap a layer of hot air in the top of primary combustion chamber 14. In one embodiment, the distance between top wall 16 and the bottom of a lip 100 in front wall 24 is at least twice the height of lip 98, exemplary dimensions being 6 inches and 3 inches, respectively. Obviously if lip 98 is larger than lip 100, hot air could escape out of the front opening in front wall 24 when door 22 is open.

It should be noted that the flow of room air being heated in room air heating chamber 36 is generally counter to the flow of flue gas in secondary combustion chamber 26. This counter flow results in a greater heat transfer from the flue gas and secondary combustion chamber 26 to the room air in room air heating chamber 36. The circulation of room air through room air heating chamber 36 is conveniently provided by natural convection. However, the efficiency of the room air heating can be substantially increased by providing forced air circulation in room air heating chamber 36. It should also be noted that by providing air inlets 60 and 61 at the bottom of room air heating chamber 36, the coolest air in the room is drawn into room air heating chamber 36 to be heated.

One problem which may occur when fireplace furnace 10 is inserted in fireplace 12 is that the chimney may not draw well. This is caused by the large chimneys which are provided to accommodate excess air flow occurring during an open fire in fireplace 12. By providing door 22 with two seals and a pressurized air source to introduce combustion air into primary inlet duct 50 and secondary air inlet duct 54, fireplace furnace 10 can be operated at a positive pressure with respect to the room to be heated. In this manner, combustion products are forced up the chimney and to not leak into the area to be heated. The efficiency of fireplace 12 can be further increased by preheating the primary combustion air with the exhausted flue gases in a heat exchanger (not shown) that could be located, for example, in exhaust duct 86.

Although the invention has been described in detail with respect to exemplary embodiments thereof, it will be understood by those of ordinary skill in the art that variations and modifications may be effected within the scope and spirit of the invention.

A further such variation, without limitation, of the present invention, although it has been described as an insert for a fireplace, is a free standing furnace or stove. Such a furnace or stove could be designed for a central location in the room or for a location along a wall. Obvious modifications to provide appropriate insulation to comply with local building and fire codes would have to be made. The secondary combustion chamber could then be extended completely around the primary chamber and a double door arrangement provided to permit access to the primary combustion chamber.

I claim:

1. A furnace for the hot air heating of a room comprising:

an enclosed primary combustion chamber for burning a fuel, the burned fuel producing a flue gas containing volatiles;

an enclosed room air heating chamber for heating the room air; and an enclosed secondary combustion chamber for burning the volatiles remaining in the flue gas from said primary combustion chamber, said secondary combustion chamber substantially surrounds the primary combustion chamber;

means for supplying combustion air to said secondary combustion chamber, said secondary combustion chamber being disposed between said primary combustion chamber and said room air heating chamber such that the heat transferred to said room air heating chamber is not transferred directly from said primary combustion chamber.

2. A fireplace furnace as claimed in claim 1 further including a layer of insulation located about said primary combustion chamber.

3. A fireplace furnace as claimed in claims 1 or 2 further including a primary air supply means for supplying combustion air to said primary combustion chamber and a secondary air supply means for supplying combustion air to said secondary combustion chamber, said secondary air supply means including an air duct passing through said primary combustion chamber such that the air delivered from said secondary air supply means is preheated before delivery to said secondary combustion chamber.

4. A fireplace furnace as claimed in claim 3 wherein said fireplace furnace has exterior walls of a size and a shape so as to be insertable into an existing, built in fireplace.

5. A fireplace furnace as claimed in claim 3 further including a substantially air tight access door provided in said primary combustion chamber and adjustable air dampers for said primary air supply means and said secondary air supply means.

6. A fireplace furnace as claimed in claim 1 further including an exhaust duct in fluid communication with said secondary combustion chamber and a baffle means disposed in said secondary combustion chamber for directing the flue gas of said secondary combustion chamber around the outside of said primary combustion chamber to said exhaust duct.

7. A fireplace furnace as claimed in claim 6 wherein said room air heating chamber has at least one inlet and at least one outlet positioned such that the flow of room air through said room air heating chamber is counter flow to the flow of the flue gas of said secondary combustion chamber.

8. A fireplace furnace as claimed in claim 6 further including a baffle bypass means for the flue gas of said secondary combustion chamber such that during start-up the flue gas in said secondary combustion chamber travels directly to said exhaust duct.

9. A furnace for the hot air heating of a room comprising:

an enclosed primary combustion chamber in which a fuel is burned, said primary combustion chamber having a top, back and sides;

a primary air supply means for supplying combustion air to said primary combustion chamber;

an enclosed secondary combustion chamber in which volatiles remaining in the flue gas from said primary combustion chamber are burned, said secondary combustion chamber being located in fluid communication with, but outside of, said primary combustion chamber and having a top and sides spaced from the top and sides of said primary combustion chamber;

a secondary air supply means for supplying combustion air to said secondary combustion chamber;

a baffle plate located between the tops of said primary combustion chamber and said secondary combustion chamber and extending downwardly between said sides of said primary combustion chamber and secondary combustion chamber so as to leave a gap near the lowermost space between said sides;

an exhaust duct in fluid communication with said secondary combustion chamber; and an enclosed room air heating chamber surrounding the top and sides of said secondary combustion chamber, said room air heating chamber having at least one room air inlet and at least one room air outlet such that as fuel is burned in the fireplace furnace, room air is drawn into said room air inlet, is heated in the space between said room air heating chamber and said secondary combustion chamber with none of the heat transferred directly from said primary combustion chamber, and is directed out of said room air outlet to heat the room.

10. A fireplace furnace as claimed in claim 9 further including an adjustable flue gas damper means for directing the flue gas from said secondary combustion chamber directly to said exhaust duct during warm-up of the fireplace furnace and for permitting the flue gas in said secondary combustion chamber to flow around said baffle plate during continued operation.

11. A fireplace furnace as claimed in claim 10 wherein said primary combustion chamber includes a primary flue gas outlet located at the back of said primary combustion chamber and adjacent the top of said primary combustion chamber, said primary outlet providing fluid communication between said primary combustion chamber and said secondary combustion chamber.

12. A fireplace furnace as claimed in claim 11 wherein said secondary combustion chamber has a back spaced from the back of said primary combustion chamber and said secondary air supply means includes an air duct passing through said primary combustion chamber and leading to the space between the backs of said primary combustion chamber and said secondary combustion chamber whereby the combustion air for said secondary combustion chamber is preheated.

13. A fireplace furnace as claimed in claims 11 or 12 further including adjustable air dampers for said primary air supply means and said secondary air supply means.

14. A fireplace furnace as claimed in claim 13 further including an airtight access door provided in said primary combustion chamber.

15. A fireplace furnace as claimed in claim 13 wherein the room air to be heated flows counter to the flue gas flowing in said secondary combustion chamber.

16. A fireplace furnace as claimed in claim 11 further including a lip depending from the back edge of the top of said primary combustion chamber into said primary flue gas outlet such that a layer of hot air is trapped in the top of said primary combustion chamber.

17. A fireplace furnace as claimed in claims 9 or 16 further including a layer of insulation located on said enclosed primary combustion chamber.

18. A method for the hot air heating of a room comprising the steps of:

burning a fuel in an enclosed primary combustion chamber;

directing the flue gas containing volatiles from the burning of the fuel in the primary combustion chamber to an enclosed secondary combustion chamber that substantially surrounds the primary combustion chamber;

burning the volatiles in the flue gas in the secondary combustion chamber;

directing the flue gas from the burning of the volatiles in the secondary combustion chamber in a path around a portion of the primary combustion chamber; and heating room air in a room air heating chamber disposed around the path of the flue gas in the secondary combustion chamber by conductive heat transfer from the secondary combustion chamber so that heat transfer occurs only after secondary combustion and so that no direct conductive heat transfer occurs from the primary combustion chamber.

19. A method for heating a room as claimed in claim 18 further including the step of preheating combustion air for the secondary combustion chamber by directing the air through the primary combustion chamber.

20. A furnace or stove comprising:

an enclosed primary combustion chamber for burning a fuel, the burned fuel producing a flue gas containing volatiles;

means for supplying a primary air supply to said primary combustion chamber;

an enclosed secondary combustion chamber for burning the volatiles remaining in the flue gas from said primary combustion chamber, said secondary combustion chamber immediately surrounding and abutting said primary combustion chamber so as to limit heat removal from said primary combustion chamber to the environment and so as to permit flue gases exiting said primary combustion chamber to attain a high temperature;

means for providing fluid communication for the flue gases between said primary and secondary combustion chambers; and means for supplying a secondary air supply to said secondary combustion chamber.

21. A furnace as claimed in claim 20 further including a substantially air tight access door provided in said primary combustion chamber and adjustable air dampers for said primary air supply means and said secondary air supply means.

22. A furnace as claimed in claim 20 further including an exhaust duct in fluid communication with said secondary combustion chamber and a baffle means disposed in said secondary combustion chamber for directing the flue gas of said secondary combustion chamber around the outside of said primary combustion chamber to said exhaust duct.

23. A furnace as claimed in claim 22 further including a baffle bypass means for the flue gas of said secondary combustion chamber such that during start-up the flue gas in said secondary combustion chamber travels directly to said exhaust duct.

24. A furnace as claimed in claim 20 and further including means for preheating said secondary air supply.

25. A furnace as claimed in claim 20 and further including an enclosed environmental air heating chamber for heating environmental air, said environmental air heating chamber surrounding said secondary combustion chamber and having an inlet and an outlet.

26. A furnace as claimed in claim 20 further including a layer of insulation located about said primary combustion chamber.

* * * * *